US005816243A

United States Patent [19]

Georgiou

[11] Patent Number: 5,816,243

[45] Date of Patent: Oct. 6, 1998

[54] AIR SUPPLY APPARATUS

[76] Inventor: Panayis Georgiou, 15 Green Moor Link, London, England, N21 2NN

[21] Appl. No.: 997,933

[22] Filed: Dec. 24, 1997

[51] Int. Cl.[6] ..... A62B 7/00

[52] U.S. Cl. ..... 128/205.24; 128/201.25; 128/201.22; 128/205.25

[58] Field of Search ..... 128/201.25, 205.24, 128/205.25, 205.22, 205.27, 206.17, 207.12, 204.18, 202.22, 205.23

[56] References Cited

U.S. PATENT DOCUMENTS

| | | | |
|---|---|---|---|
| 4,440,163 | 4/1984 | Spergel | 128/205.13 |
| 4,702,243 | 10/1987 | Saith | 128/205.24 |
| 5,069,205 | 12/1991 | Urso | 128/201.24 |
| 5,191,317 | 3/1993 | Toth et al. | 340/676 |
| 5,410,757 | 5/1995 | Vienamo et al. | 2/9 |
| 5,562,092 | 10/1996 | George | 128/201.25 |

FOREIGN PATENT DOCUMENTS

| | | | |
|---|---|---|---|
| 768083 | 3/1934 | France | 128/205.22 |

*Primary Examiner*—John G. Weiss
*Assistant Examiner*—Charles W. Anderson

[57] ABSTRACT

An emergency air supply mask is provided including a head assembly having a transparent face portion defining a rear peripheral edge. The face portion has a plurality of bores formed therein. A filter unit includes a transparent plate and at least one bore formed therein. The plate is coupled in spaced relationship to the face portion of the head assembly via a closed periphery. Such periphery has an opening for allowing the selective insertion of a transparent filter therein.

14 Claims, 2 Drawing Sheets

AIR SUPPLY APPARATUS

BACKGROUND OF THE INVENTION

1. Field of the Invention

The present invention relates to fire hoods and more particularly pertains to a new air supply apparatus for supplying a user with air during an emergency situation.

2. Description of the Prior Art

The use of fire hoods is known in the prior art. More specifically, fire hoods heretofore devised and utilized are known to consist basically of familiar, expected and obvious structural configurations, notwithstanding the myriad of designs encompassed by the crowded prior art which have been developed for the fulfillment of countless objectives and requirements.

Known prior art fire hoods include U. S. Pat. No. 4,702,243; U.S. Pat. No. 4,440,163; U.S. Pat. No. 4,669,462; U.S. Pat. No. 5,429,125; U.S. Pat. No. 4,173,220; and U.S. Pat. Des. 283,742.

In these respects, the air supply apparatus according to the present invention substantially departs from the conventional concepts and designs of the prior art, and in so doing provides an apparatus primarily developed for the purpose of supplying a user with air during an emergency situation.

SUMMARY OF THE INVENTION

In view of the foregoing disadvantages inherent in the known types of fire hoods now present in the prior art, the present invention provides a new air supply apparatus construction wherein the same can be utilized for supplying a user with air during an emergency situation.

The general purpose of the present invention, which will be described subsequently in greater detail, is to provide a new air supply apparatus and method which has many of the advantages of the fire hoods mentioned heretofore and many novel features that result in a new air supply apparatus which is not anticipated, rendered obvious, suggested, or even implied by any of the prior art fire hoods, either alone or in any combination thereof.

To attain this, the present invention generally comprises a head assembly with a rigid transparent bulbous face portion defining a generally circular rear peripheral edge. The front face portion further has an aperture formed in a bottom face thereof adjacent to the rear peripheral edge and a plurality of bores formed in a top face thereof also adjacent to the rear peripheral edge, as shown in FIGS. 1 & 2. A flexible hood portion is mounted to the rear peripheral edge of the face portion for defining a circular bottom opening. A lateral elastic strap with an adjustable length is secured between diametrically opposed sides of the rear peripheral edge of the face portion. Such lateral elastic strap extends around a rear of the hood portion. Associated therewith is a longitudinal elastic strap with an adjustable length having a first end connected to a top of the rear peripheral edge of the face portion and a second end connected to a central extent of the lateral strap. Next provided is a filter unit including a generally rectangular transparent interior plate. The interior plate has a radius of curvature equal to that of the face portion of the head assembly and a plurality of bores formed therein. The plate is coupled in spaced relationship with an interior surface of the face portion of the head assembly via a transparent closed periphery. Such closed periphery has an opening only at a top extent thereof for allowing the selective insertion of a transparent filter therein. Such transparent filter is preferably constructed from a multiplicity of transparent fibers. Next included is an insulated air supply assembly having a cylindrical tank. The tank is equipped with an outlet conduit coupled to a top face thereof and extending upwardly in coaxial relation therewith. A top end of the conduit is sealingly coupled to the aperture of the face portion of the head assembly. The conduit further has an eyelet pin mounted therein for allowing the supply of air from the tank to the head assembly only upon removal. As shown in FIG. 2, the tank resides in front of a chest of a user during use. Mounted to the tank is a gauge for indicating an amount of air within the tank. A nipple is situated within the conduit at the aperture of the face portion of the head assembly for emitting a noise. Such noise is emitted only upon an existing air flow from the conduit to the face portion of the head assembly falling below a predetermined amount. As such, the nipple functions for audibly alerting the user of a decreasing amount of air within the tank. Also included is an excess pressure relief valve mounted on the tank. The excess pressure relief valve is provided for releasing air therefrom upon a pressure therein surpassing a predetermined amount. Finally, a chest pad having a rectangular configuration is coupled in tangential relationship with the tank and situated between the tank and the user during use.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new air supply apparatus and method which has many of the advantages of the fire hoods mentioned heretofore and many novel features that result in a new air supply apparatus which is not anticipated, rendered obvious, suggested, or even implied by any of the prior art fire hoods, either alone or in any combination thereof.

It is another object of the present invention to provide a new air supply apparatus which may be easily and efficiently manufactured and marketed.

It is a further object of the present invention to provide a new air supply apparatus which is of a durable and reliable construction.

An even further object of the present invention is to provide a new air supply apparatus which is susceptible of a low cost of manufacture with regard to both materials and labor, and which accordingly is then susceptible of low prices of sale to the consuming public, thereby making such air supply apparatus economically available to the buying public.

Still yet another object of the present invention is to provide a new air supply apparatus which provides in the apparatuses and methods of the prior art some of the advantages thereof, while simultaneously overcoming some of the disadvantages normally associated therewith.

Still another object of the present invention is to provide a new air supply apparatus for supplying a user with air during an emergency situation.

Even still another object of the present invention is to provide a new air supply apparatus that includes a head assembly having a transparent face portion defining a rear peripheral edge. The face portion has a plurality of bores formed therein. A filter unit includes a transparent plate and at least one bore formed therein. The plate is coupled in spaced relationship to the face portion of the head assembly via a closed periphery. Such periphery has an opening for allowing the selective insertion of a transparent filter therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
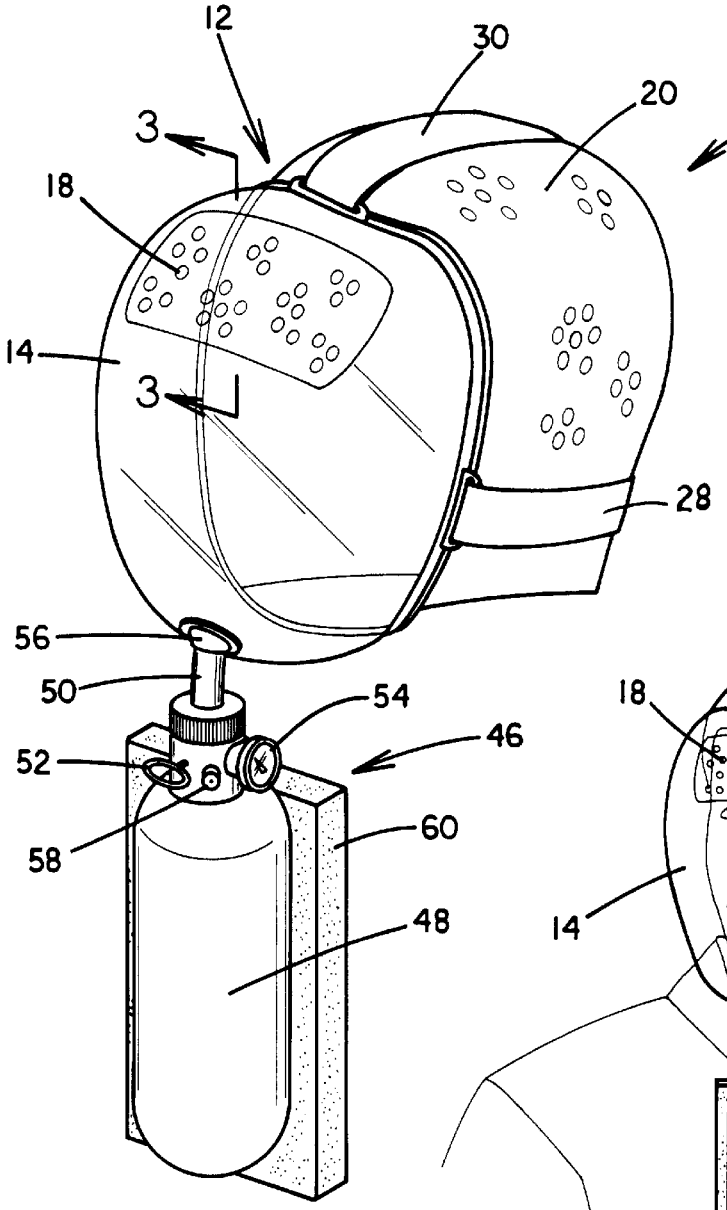
FIG. 1 is a side perspective view of a new air supply apparatus according to the present invention.

With reference now to the drawings, and in particular to FIGS. 1 through 4 thereof, a new air supply apparatus embodying the principles and concepts of the present invention and generally designated by the reference numeral 10 will be described.

Figure 2:
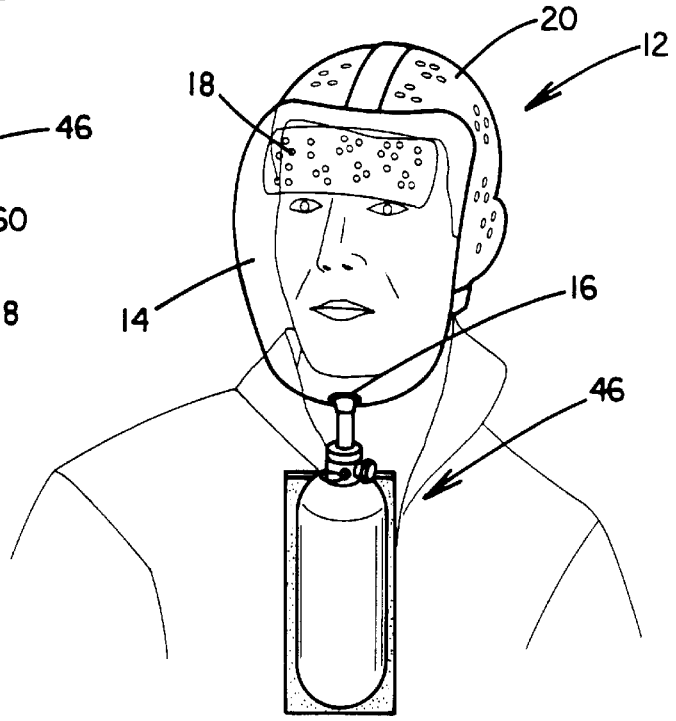
FIG. 2 is a front perspective view of the present invention.
Figure 3:
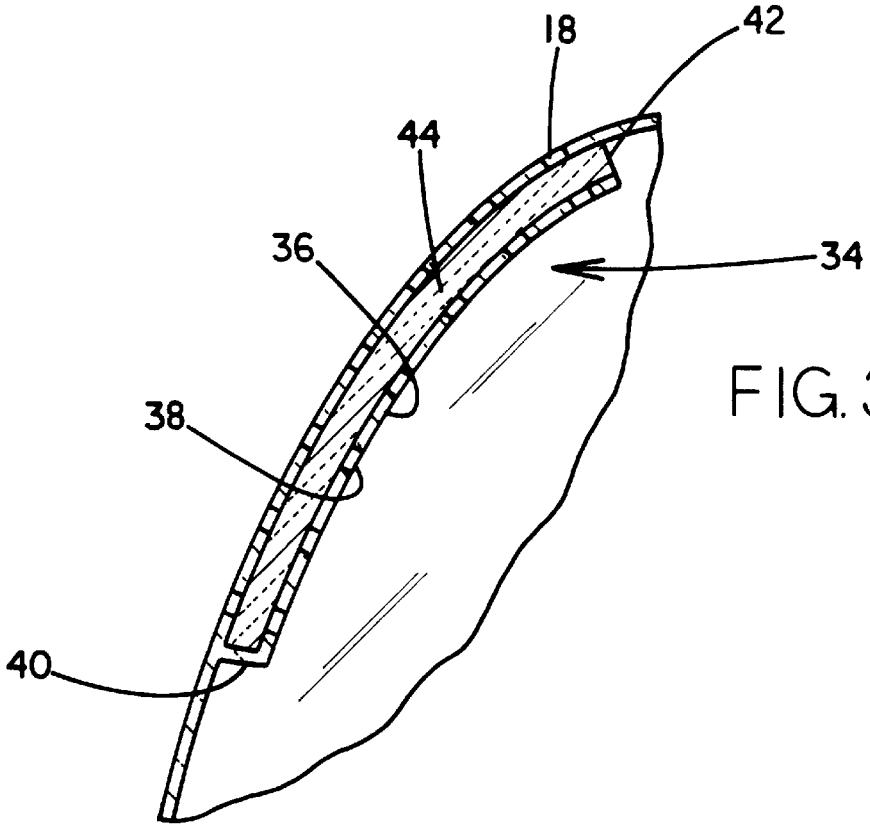
FIG. 3 is a cross-sectional view of the filter unit of the present invention.

The present invention, designated as numeral 10, includes a head assembly 12 with a rigid transparent bulbous face portion 14 defining a generally circular rear peripheral edge which resides in a vertical plane during use. The front face portion further has an aperture 16 formed in a bottom face thereof adjacent to the rear peripheral edge and a plurality of bores 18 formed in a top face thereof also adjacent to the rear peripheral edge, as shown in FIGS. 1 & 2. As an option, the face portion may be polarized or tinted.

Figure 4:
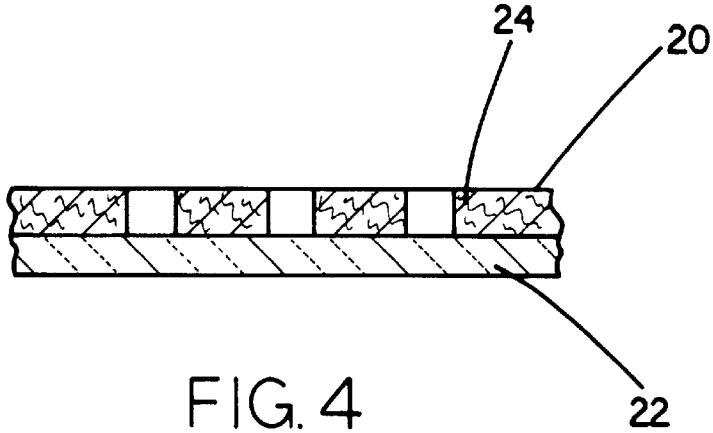
FIG. 4 is a cross-sectional view of the flexible hood of the present invention.

A flexible hood portion 20 is mounted to the rear peripheral edge of the face portion for defining a circular bottom opening. As shown in FIG. 4, the hood has two layers one of which is an inner closed insulation layer 22. Formed on an exterior of the insulation layer is a fire retarding material 24 with a plurality of breather holes formed therein. As an option, a rear of the hood may extend downwardly and form a pocket for encompassing elongated hair of a user.

A lateral elastic strap 28 with an adjustable length is secured between diametrically opposed sides of the rear peripheral edge of the face portion. Such lateral elastic strap extends around a rear of the hood portion. When the hood is worn, the lateral strap preferably extends below the cars of the user. Associated therewith is a longitudinal elastic strap 30 with an adjustable length having a first end connected to a top of the rear peripheral edge of the face portion and a second end connected to a central extent of the lateral strap.

Next provided is a filter unit 34 including a generally rectangular transparent interior plate 36. The interior plate has a radius of curvature equal to that of the face portion of the head assembly and a plurality of bores 38 formed therein. The plate is coupled in spaced relationship with an interior surface of the face portion of the head assembly via a transparent closed periphery 40. Such closed periphery has an opening 42 only at a top extent thereof for allowing the selective insertion of a transparent filter 44 therein. Such transparent filter is preferably constructed from a multiplicity of transparent fibers. In the preferred embodiment, the filter unit has a surface area equal to about ⅓ that of the full face portion of the head assembly.

Next included is an air supply assembly 46 having an insulated cylindrical tank 48. The tank is equipped with an outlet conduit 50 screwably coupled to a top face thereof and extending upwardly in a coaxial relationship therewith. A top end of the conduit is sealingly coupled to the aperture of the face portion of the head assembly. The conduit further has an eyelet pin 52 mounted therein for allowing the supply of air from the tank to the head assembly only upon removal. As shown in FIG. 2, the tank resides in front of a chest of a user during use.

Mounted to the tank is a gauge 54 for indicating an amount of air within the tank. A nipple 56 is situated within the conduit at the aperture of the face portion of the head assembly for emitting a noise. Such noise is emitted only upon an existing air flow from the conduit to the face portion of the head assembly falling below a predetermined amount. As such, the nipple functions for audibly alerting the user of a decreasing amount of air within the tank. As an option, instead of the nipple, a flow meter and accompanying electric alarm may monitor the air flow and afford a similar function.

Also included is an excess pressure relief valve 58 mounted on the tank. The excess pressure relief valve is provided for releasing air therefrom upon a pressure therein surpassing a predetermined amount. Finally, a chest pad 60 having a rectangular configuration and a length equal to that of the tank is coupled in tangential relationship with the tank and situated between the tank and the user during use.

Preferably, the density of the filter of the filter unit is such that air exits the face portion at a rate less than that which it enters the same. This facilitates breathing. When the air runs out, the filter further allows continued breathing until the tank of the air supply assembly can be changed. As an option, poisonous gas indicators may be positioned on the head assembly for allowing a user to track deadly gases. Further, a radio or cellular unit may be mounted onto the head assembly for communication purposes. Yet another option is to employ a rigid hood portion for affording additional protection to the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An emergency air supply mask comprising, in combination:

a head assembly including a rigid transparent bulbous face portion defining a generally circular rear peripheral edge and having an aperture formed in a bottom face thereof adjacent to the rear peripheral edge and a plurality of bores formed in a top face thereof also adjacent to the rear peripheral edge, a flexible hood portion mounted to the rear peripheral edge of the face portion for defining a circular bottom opening, a lateral elastic strap with an adjustable length mounted between diametrically opposed sides of the rear peripheral edge of the face portion and extending around a rear of the hood portion, a longitudinal elastic strap with an adjustable length having a first end connected to a top of the rear peripheral edge of the face portion and a second end connected to a central extent of the lateral strap;

a filter unit including a generally rectangular transparent interior plate having a radius of curvature equal to that of the face portion of the head assembly and a plurality of bores formed therein, the plate coupled in spaced relationship to an interior surface of the face portion of the head assembly via a transparent closed periphery which has an opening only at a top extent thereof for allowing the selective insertion of a transparent filter therein;

an insulated air supply assembly including a cylindrical tank having an outlet conduit coupled to a top face thereof and extending upwardly in coaxial relation therewith, wherein a top end of the conduit is sealingly coupled to the aperture of the face portion of the head assembly, the conduit having an eyelet pin mounted therein for allowing the supply of air from the tank to the head assembly only upon the removal thereof, wherein the tank resides in front of a chest of a user during use;

a gauge mounted to the tank for indicating an amount of air within the tank;

a nipple situated within the conduit at the aperture of the face portion of the head assembly for emitting a noise upon an existing air flow from the conduit to the face portion of the head assembly falling below a predetermined amount for audibly alerting the user of a decreasing amount of air within the tank;

an excess pressure relief valve mounted on the tank for releasing air therefrom upon a pressure therein surpassing a predetermined amount; and a chest pad having a rectangular configuration mounted in tangential relationship with the tank and situated between the tank and the user during use.

2. An emergency air supply mask comprising:

a head assembly including a transparent face portion defining a rear peripheral edge and having a plurality of bores formed therein; and a filter unit including a transparent plate and at least one bore formed therein, the plate coupled in spaced relationship to the face portion of the head assembly via a closed periphery which has an opening for allowing the selective insertion of a transparent filter therein.

3. An emergency air supply mask as set forth in claim 2 wherein the interior plate is mounted to an interior surface of the face portion of the head assembly.

4. An emergency air supply mask as set forth in claim 2 wherein the interior plate has a radius of curvature equal to that of the face portion of the head assembly.

5. An emergency air supply mask as set forth in claim 2 wherein the bores and plate are mounted to a top of the face portion of the head assembly.

6. An emergency air supply mask as set forth in claim 2 and further including a flexible hood portion mounted to the rear peripheral edge of the face portion for defining a bottom opening.

7. An emergency air supply mask as set forth in claim 2 and further including a lateral strap with mounted between diametrically opposed sides of the rear peripheral edge of the face portion and a longitudinal strap having a first end connected to a top of the rear peripheral edge of the face portion and a second end connected to a central extent of the lateral strap.

8. An emergency air supply mask as set forth in claim 2 and further including an air supply assembly mounted to the face portion of the head assembly.

9. An emergency air supply mask as set forth in claim 8 wherein the air supply assembly includes a tank residing in front of a chest of a user during use.

10. An emergency air supply mask as set forth in claim 9 wherein a chest pad is mounted between the tank and the user during use.

11. An emergency air supply mask as set forth in claim 8 wherein the air supply assembly has a pin mounted therein for allowing the supply of air from the tank to the head assembly only upon the removal thereof.

12. An emergency air supply mask as set forth in claim 8 wherein a gauge is included for indicating an amount of air within the tank.

13. An emergency air supply mask as set forth in claim 8 and further including a means for emitting a noise upon an existing air flow from the air supply assembly to the face portion of the head assembly falling below a predetermined amount for audibly alerting the user of a decreasing amount of air.

14. An emergency air supply mask as set forth in claim 8 and further included is an excess pressure relief valve for releasing air therefrom upon a pressure within the air supply assembly surpassing a predetermined amount.

* * * * *